United States Patent [19]

Grennan

[11] Patent Number: 4,763,425

[45] Date of Patent: Aug. 16, 1988

[54] AUTOMATIC CLOTHES DRYER

[75] Inventor: Richard L. Grennan, Green Lake, Wis.

[73] Assignee: Speed Queen Company, Ripon, Wis.

[21] Appl. No.: 66,378

[22] Filed: Jun. 25, 1987

[51] Int. Cl.[4] ..... F26B 21/06

[52] U.S. Cl. ..... 34/48; 34/53; 34/55

[58] Field of Search ..... 34/48, 55, 53, 44

[56] References Cited

U.S. PATENT DOCUMENTS

| | | | |
|---|---|---|---|
| 4,418,271 | 11/1983 | Smock | 34/48 |
| 4,531,305 | 7/1985 | Nagayasu et al. | 34/48 |
| 4,622,759 | 11/1986 | Abe et al. | 34/44 |
| 4,642,907 | 2/1987 | Best | 34/55 |

*Primary Examiner*—Larry I. Schwartz

*Attorney, Agent, or Firm*—William R. Clark; Richard M. Sharkansky

[57] ABSTRACT

An automatic clothes dryer that initially determines the upper regulating or cycling temperature in accordance with the fabric type and desired dryness as input by the operator. If no desired dryness is input, a default dryness is assumed. Then, the controller measures the time period to reach the upper regulating temperature during the first heating cycle, and uses this information along with the fabric type and desired dryness to determine how many additional heating cycles will be executed to dry the clothes to the desired dryness. Further, the length of a subsequent cool down cycle is determined in accordance with the fabric type and desired dryness.

7 Claims, 4 Drawing Sheets

AUTOMATIC CLOTHES DRYER

BACKGROUND OF THE INVENTION

The field of the invention relates to clothes dryers, and more particularly to dryers having controls other than straight timers for automatically shutting off the dryer.

It is well known that the optimum temperature and drying time for clothes varies greatly as a function of the fabric type and size of the load. For example, it is generally desirable to dry at a relatively high temperature so as to minimize the drying time, but some fabric types are damaged by hot temperatures. Also, different types of fabrics have different water storage capacities and different water removal rates. Accordingly, it has long been recognized that it is desirable to customize the temperature and drying time for a particular load of clothes.

Many prior art clothes dryers have one or more temperature sensors which are used to cycle the heater on and off so as to regulate the drying temperature. For example, a dryer would typically cycle on and off at a relatively high temperature (e.g. 150° F.) for regular fabric or permanent press clothes and at a lower temperature (e.g. 130° F.) for delicate fabric clothes. Most commonly, clothes dryers have a timer, and the operator sets the drying time (e.g. 45 minutes) after which the dryer shuts off. For this type of dryer, operator experience is required to set the time accurately. If too little drying time is selected, the clothes will not be dry and the operator will have the inconvenience of incrementally adding more drying time until the desired dryness is reached. If too much drying time is selected, then heat will be wasted and energy efficiency will be adversely impacted. In an attempt to improve and simplify the selection of drying parameters such as temperature and time, various prior art approaches have been tried.

One prior art automatic dryer approach uses a timer that only runs when the heater (i.e. electric, gas, steam, etc.) is turned off by the temperature regulating device. More specifically, different temperature thermostats corresponding to respective fabric types are located in the air exhaust duct, and the heater is cycled on and off at the temperature of the selected thermostat. The timer only runs when the heater is off, so the operator is actually selecting the "off time" to be expired before the dryer automatically shuts off. Initially, when the clothes are wet, much of the heat is consumed in evaporating large amounts of moisture. Accordingly, it takes a relatively long time for the exhaust air to reach the thermostat temperature in the first heating cycle, and during this time, the automatic timer is not running. Then, when the heater is turned off because the thermostat temperature has been reached, the timer starts to run and continues to run until the heater cycles on again, at which time it stops. This cycling process repeats until the timer setting, as selected by the operator, expires. Although this approach is easier to operate than a straight timer approach, there is still a large range of settings available to the operator, and some trial and error is generally required before the operator attains the experience to obtain optimum results.

Another prior art approach counts the number of on/off heater cycles, and after a predetermined number is reached, the dryer shuts off. More specifically, in one prior art commercial dryer, the operator selects between three settings that correspond to HIGH, PERM PRESS, and LOW temperature settings. The dryer includes a microprocessor and a look-up table matrix of settings such that, as preprogrammed by the owner of the dryer, each operator selected setting corresponds to a particular temperature and a particular number of heater cycles. For example, for the HIGH temperature selection, the owner may select between 190° F., 185° F., and 180° F. as the cycling temperature. Also, for example, the owner may preprogram the auto dry level such that the microprocessor would count from 5 up to 14 on/off cycles before terminating the drying operation. As an illustration, if the owner had preprogrammed 185° and 9 cycles for the HIGH setting and the operator selected the HIGH setting, the dryer would cycle on and off 9 times at an upper temperature of 185° F., and then the dryer would be shut off. As with the previously described approach, this approach also has a drawback in that it relies on experience to customize the dryer setting for the particular clothes load. If the owner/operator has no experience and therefore guesses at selections, or relies on a default selections, the result could likely be over or under dried clothes. Once the owner/operator experiences this problem, compensation can be made for the next clothes load that is similar in nature. Eventually, the owner/operator can develop a proficiency with the control so as to compensate for various clothes loads so as to achieve the desired results. However, there is still a need to have a control that operates satisfactorily without individual experience.

The prior art also includes automatic control systems that measure the moisture content of the clothes. One type has a sensor in the exhaust duct that senses the moisture. The other measures the electrical resistance of the clothes in the dryer; as the clothes become dryer, their electrical resistance drops. These moisture sensors, however, are relatively expensive, and are subject to failure and miscalibration.

SUMMARY OF THE INVENTION

It is an object of the invention to provide an improved method and apparatus for automatically shutting off a clothes dryer when the clothes reach the desired dryness.

It is a another object to automatically determine the drying duration for a given load of clothes.

It is also an object to use the cycle time during the first heating cycle to determine how many additional drying cycles are required to dry the clothes to a desired dryness level.

Further, it is an object to determine the length of a cool down cycle in accordance with the fabric type and desired dryness.

The above and other objects are provided by the invention which defines the method of drying clothes in a clothes dryer, comprising the steps of measuring the time to raise a thermal sensor of the dryer to a predetermined temperature, determining the remaining number of on and off temperature regulating cycles in accordance with that measured time and the fabric type of said clothes, and activating said dryer for said remaining number of cycles. The temperature regulating cycles are defined by cycling the heat source on and off.

The invention may further be practiced by the method of controlling a clothes dryer comprising the steps of cycling the heat source of the dryer on and off to regulate the dryer temperature, and determining the total number of cycles in accordance with the on-time of the heat source during the first of the cycles, and deactivating said heat source of said dryer after said total number of cycles. The drying temperature may be determined in accordance with the fabric type and the desired final dryness of the clothes as input through the control panel by the operator.

The invention further defines the method of drying clothes in a clothes dryer which cycles the heat source on and off to regulate the drying temperature, comprising the steps of measuring a time interval corresponding to the first of the cycles, determining the duration of remaining cycles in accordance with the first cycle time interval and the fabric type of the clothes, and activating the heat source for the remaining duration.

The invention may further be practiced by the method of drying clothes in a clothes dryer which, in response to a thermal sensor, cycles the heat source on and off to regulate the maximum drying temperature, comprising the steps of determining the maximum drying temperature in acccordance with the fabric type of the clothes, measuring the on-time of the heat source to reach the maximum drying temperature during the first of the cycles, determining the remaining number of cycles to be executed in accordance with the first cycle on-time, and counting the number of cycles until the remaining number of cycles is reached, and then terminating the drying of the clothes. The maximum drying temperature may also be determined in accordance with the desired final dryness of the clothes as input by the operator. Preferably, the remaining number of cycles may be determined from a look-up table. Also, there may be a further step of executing a cool down cycle having a duration determined in accordance with the fabric type and the desired final dryness of the clothes.

The invention further defines a clothes dryer comprising a heat source, means for cycling the heat source on and off to regulate the drying temperature, means for measuring the on-time of the heat source during the first on and off cycle, and means responsive to the measured on-time for determining the total number of on and off cycles to be executed. The cycling means preferably comprises a thermal sensor for providing a signal corresponding to the drying temperature. The dryer may further comprise means for monitoring the thermal sensor, means for cycling off the heat source at a predetermined upper regulating temperature, and means for cycling the heat source back on at a predetermined lower regulating temperature.

The invention further defines a clothes dryer comprising a heat source, a thermal sensor for providing a signal corresponding to the drying temperature, means responsive to the thermal sensor signal for cycling the heat source on and off to regulate the drying temperature, means for measuring the on-time of the heat source during a first one of the on and off cycles, and means responsive to the measured time for determining the number of drying cycles to be executed. The dryer may further comprise an operator actuated control for providing a signal corresponding to the fabric type, an operator actuated control for providing a signal corresponding to the desired final dryness, and means responsive to the fabric type signal and the desired final dryness signal for determining the cycling temperature of the cycling means.

BRIEF DESCRIPTION OF THE DRAWINGS

The foregoing objects and advantages will be more fully understood by reading a description of the preferred embodiment with reference to the drawings wherein.

DESCRIPTION OF THE PREFERRED EMBODIMENT

Figure 1:
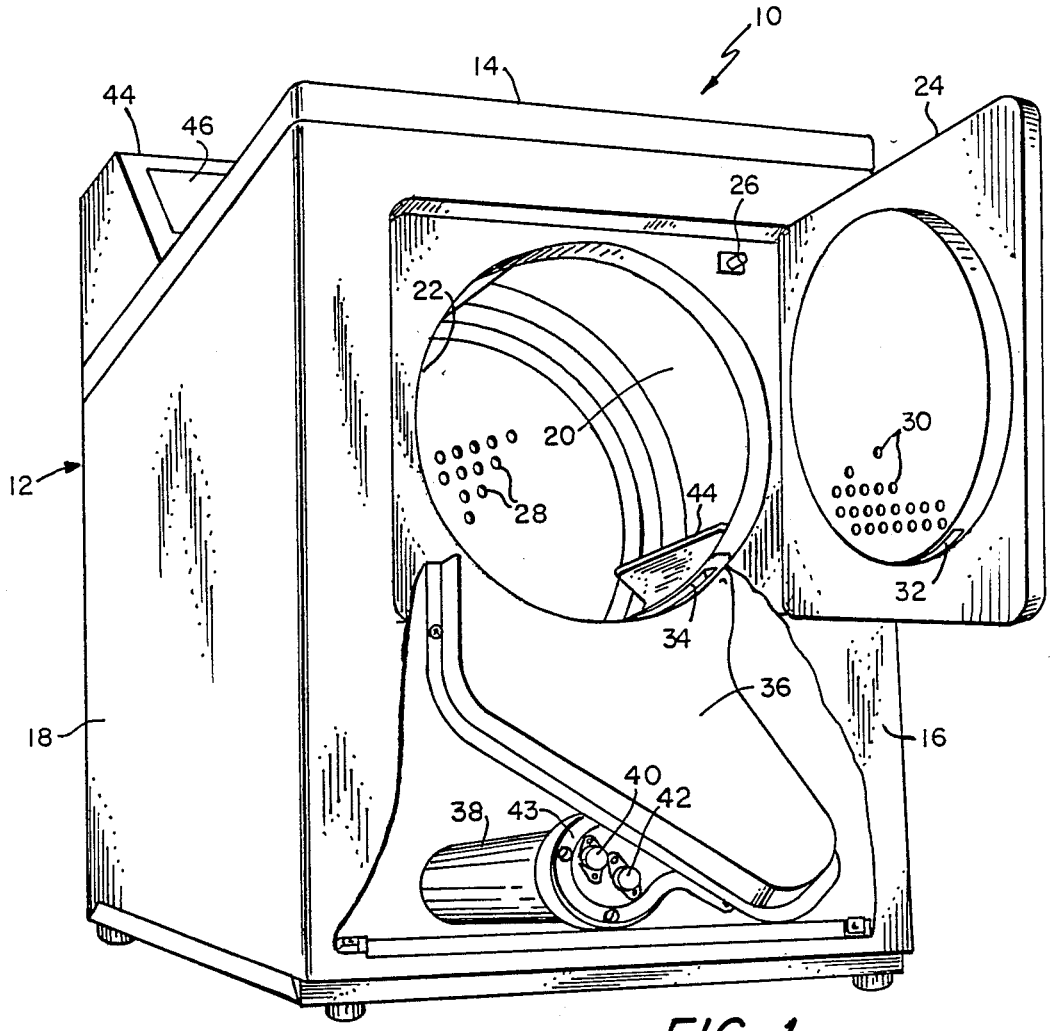
FIG. 1 is a partially broken-away front view of a dryer.
Figure 2:
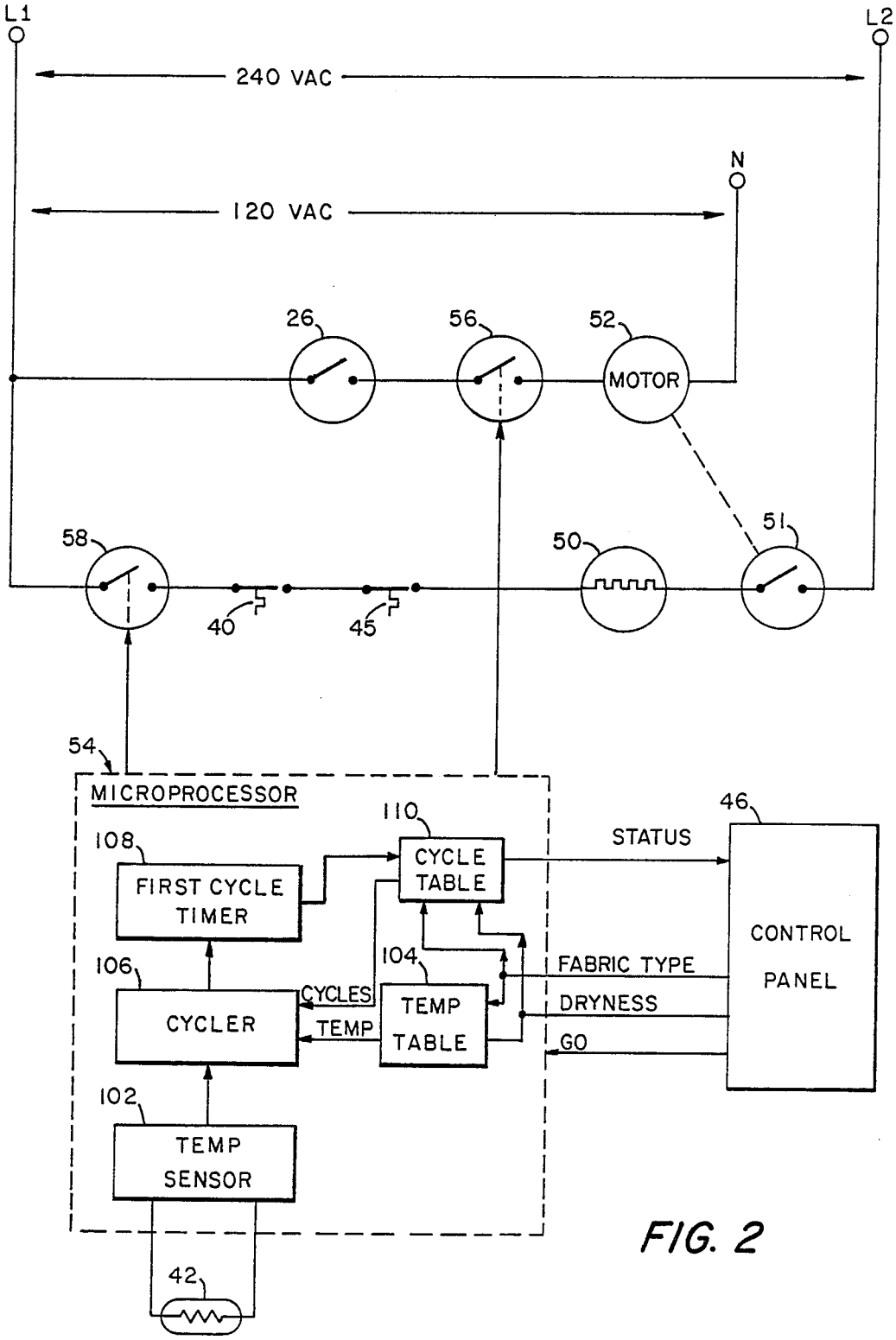
FIG. 2 is a schematic diagram of the dryer.

Referring to FIG. 1, a partially broken-away front view of a clothes dryer 10 is shown. Dryer 10 generally includes a box-shaped casing 12 including a top panel 14, front panel 16, side panels 18 and a back panel (not shown). The casing 12 encases a horizontal cylindrical clothes drum 20 having access through an opening 22 in front panel 16. Hinged door 24 is used to close opening 22 during operation and interlock switch 26 is used to sense whether the door is closed. Although other types of heating sources such as gas or steam could be used, air is here heated by an electric heating coil 50 (FIG. 2). The air flow path from the heating coil 50 is through perforations 28 into cylindrical clothes drum 20 for drying the clothes. A motor 52 (FIG. 2) is used to rotate drum 20, and with the assistance of paddles 44, the clothes are tumbled.

Still referring to FIG. 1, the air exits drum 20 by passing through perforations 30 in door 24 and down through an aperture 32 into lint filter 34 in conduit 36. Positioned behind conduit 36 at the bottom is a fan (not shown) which draws the exhaust air down conduit 36 and expells it rearwardly into exhaust duct 38. The fan and the drum 20 are both driven by motor 52 (FIG. 2). A thermal limiter switch 40 and a thermistor 42 are mounted on the end 43 of exhaust duct 38 where they can sense the temperature of the exhaust air. Another thermal limiter switch 45 (FIG. 2) is positioned proximate with said heating element 50.

Mounted on top panel 14 is a control hood 44 or console including a control panel 46 which is shown in detail in FIG. 3 and described with reference thereto.

Referring to FIG. 2, there is shown an electrical schematic of dryer 10. As will be described in detail with reference to FIGS. 3 and 4, dryer 10 has an electronic controller, here shown as microprocessor 54. In accordance with the detailed description provided hereinafter, microprocessor 54 controls relays 56 and 58. Relay 56 is in series with motor 52 and door interlock switch 26. If the door 24 is closed such that door interlock switch 26 is closed, closing relay 56 connects L1 and neutral (120 VAC) across motor 52. As described earlier herein, actuation of motor 52 causes drum 20 to rotate and the fan to draw air through drum 20. Relay 58 is in series with thermal limiter switches 40 and 45, electric resistive heating element 50, and centrifugal switch 51 of motor 52. Centrifugal switch 51 is closed when motor 52 is activated. Accordingly, if limiter switches 40 and 45 are closed, and if motor 52 is running such that centrifugal switch 51 is closed, the closing of relay 58 by microprocessor 54 connects L1 and L2 (220 volts VAC) across heating element 50. If the temperature of thermal limiter switches 40 or 45 rises above their predetermined set level, or the motor 52 ceases to operate, then heating element 50 is deenergized regardless of the state of relay 58.

Figure 4:
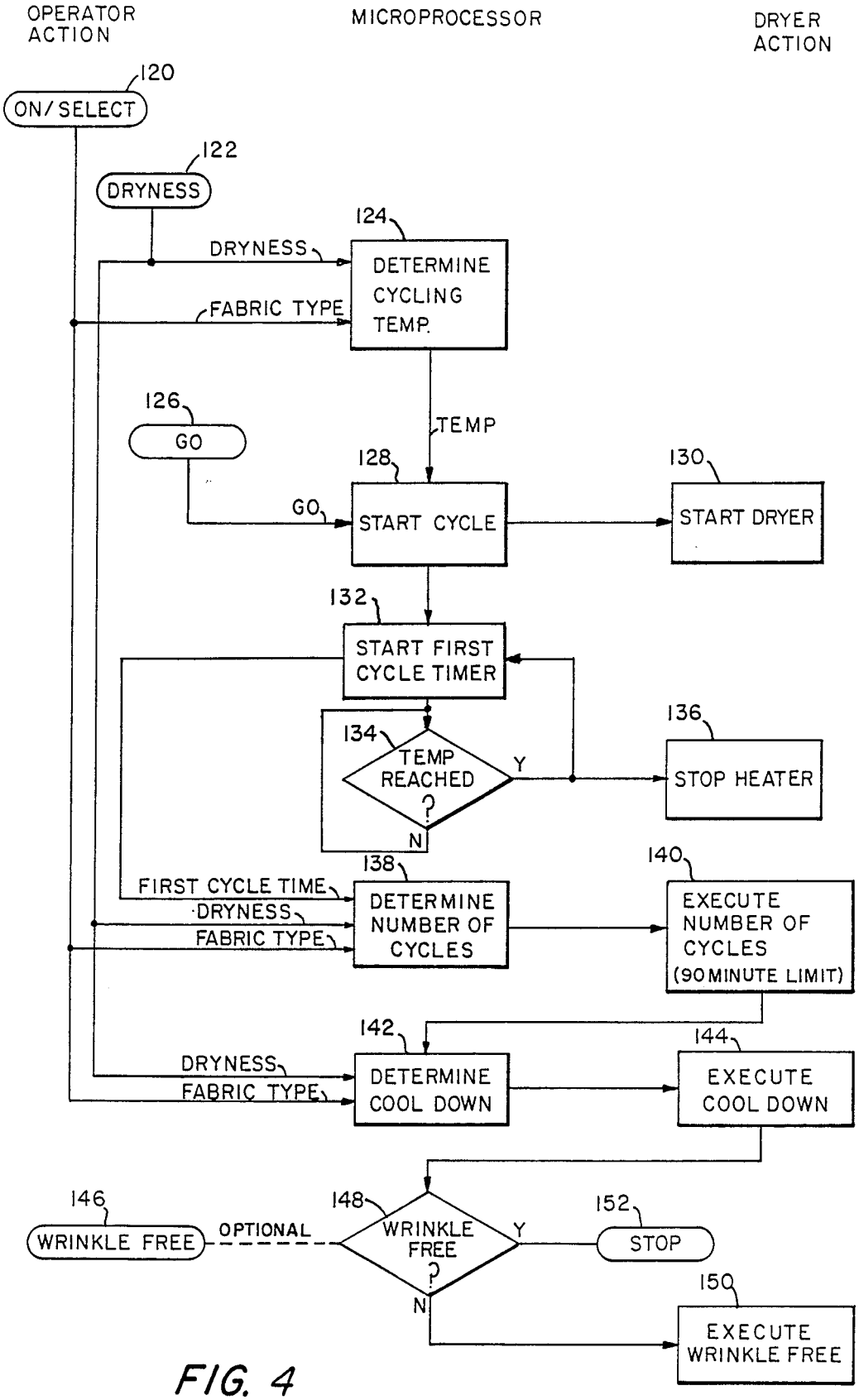
FIG. 4 is a flow diagram of the microprocessor controller of the dryer showing interface with operator action and dryer action.

Preferably, microprocessor 54 is a custom-designed integrated circuit that, in accordance with-well known practice, has a software implementation of the flow diagram of FIG. 4. Described here with reference to FIG. 2 are the functional blocks, which could also be implemented with circuit components. As input by the operator through control panel 46, microprocessor 54 receives inputs regarding the type of fabric to be dried and the final dryness that is desired. If no dryness is input, microprocessor 54 assumes normal dryness as a default. In accordance with these two parameters, microprocessor 54 uses temperature table 104 to determine the cycling or upper regulating temperature. This TEMPerature is provided to the cycler 106 which also receives an indication of the present operating temperature from temperature sensor 102. Specifically, temperature sensor 102 in conjunction with thermistor 42 senses the temperature of the exhaust air in exhaust duct 38. The resistance of thermistor 42 varies as a function of its temperature, and temperature sensor 102 measures the internal resistance of thermistor 42 and converts it to a temperature usable by cycler 106. Upon receiving a GO signal from control panel 46, cycler 106 initiates the first cycle by first closing relay 56 and then, after a few seconds of delay, closing relay 58. When upper regulating TEMP is reached, heating element 50 is deenergized by opening relay 58. The time period during this first cycle for the measured temperature to rise to the upper regulating TEMP is measured by first cycle timer 108. Generally, if the load is large, the first cycle on-time will be relatively large, and if the load is small, the first cycle on-time will be relatively small. Accordingly, the first cycle on-time is generally indicative of the size of the load. In accordance with the on-time to raise the temperature to the regulating temperature in the first cycle, and the dryness and fabric type inputs, microprocessor 54 looks up in cycle table 110 and determines the total number of cycles to be executed. Then, cycler 106 executes the determined number of cycles.

Figure 3:
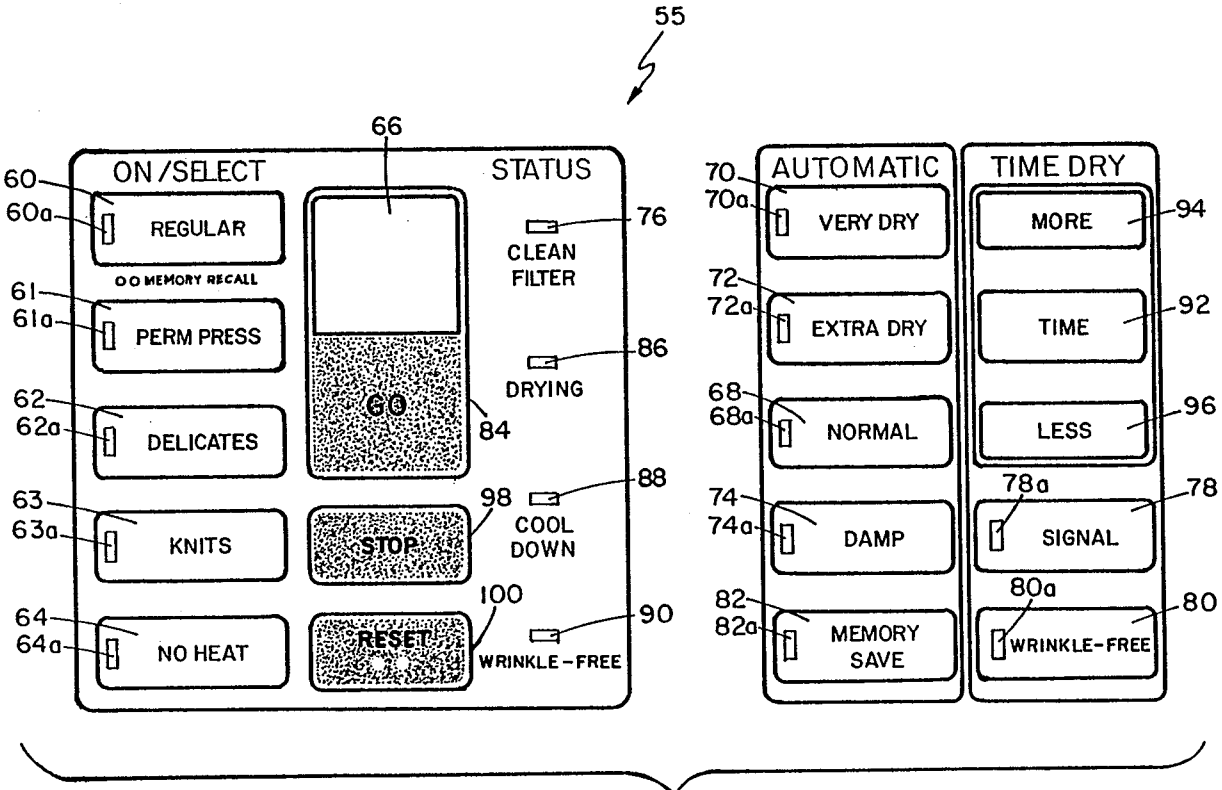
FIG. 3 is the control panel of the dryer.

Referring to FIG. 3, the graphics or control portion 55 of control panel 46 is shown. Positioned behind the various graphics touch pads, which will be described in detail, are switches such as, for example, membrane switches (not shown) which are scanned by microprocessor 54 so as to receive command inputs from the operator. Also, there are a plurality of light emitting diodes or LED indicators which are used by microprocessor 54 to provide the operator with operational information. To initiate any mode of operation, the operator first selects one of the ON/SELECT controls 60–64. These controls or touch pads "wake up" microprocessor 54 and indicate that a dryer operation is about to be initiated. REGULAR touch pad 60, PERM PRESS touch pad 61, DELICATES touch pad 62 and KNITS touch pad 63 each provide an indication of the type of fabric to be dried. NO HEAT touch pad 64 indicates a fluff mode of operation is to be performed with no heat (i.e. heating element 50 is not to be activated).

Upon selecting a fabric type by pressing one of touch pads 60–63, the respective LED **60*a*–63*a* is illuminated and microprocessor 54 displays AU in display 66. This means microprocessor 54 is ready for AUTOmatic operation. A default selection of NORMAL is assumed as the desired final dryness of the clothes and LED 68A is illuminated on NORMAL touch pad 68. If the operator desires more or less dryness than NORMAL, the VERY DRY touch pad 70, EXTRA DRY touch pad 72 or DAMP touch pad 74 can be pressed at this time and the respective LED 70*a*, 72*a*, or 74*a* will be illuminated as NORMAL LED 68*a* is extinguished. Selecting one of ON/SELECT touch pads 60–63 will also cause microprocessor 54 to flash CLEAN FILTER LED 76 as a reminder to the operator to clean filter 34**.

Before starting an AUTOMATIC drying operation, other optional commands may be entered into microprocessor 54 using SIGNAL touch pad 78, WRINKLE-FREE touch pad 80 and MEMORY SAVE touch pad 82, each of which has a corresponding LED indicator **78*a*, 80*a* and 82*a*. MEMORY SAVE touch pad 82 is used to store the selected parameters in microprocessor 54. In other words, it can be used to alter the default parameters that are selected by the microprocessor. If the MEMORY SAVE touch pad 82 is pressed before pressing GO touch pad 84, the same drying operation can be subsequently selected by merely touching the desired ON/SELECT touch pad 60–63 twice. SIGNAL touch pad 78 is used to control whether an audio signal is provided at the end of the operation, and if so, what the audio level will be. WRINKLE-FREE touch pad 80 provides a 99 minute extended cool down cycle wherein there is 30 seconds of tumble every 5 minutes until the 99 minute time has expired or the dryer door 24 is opened. If the cycle is to be resumed after opening door 24, the GO touch pad 84** must be pressed.

Upon pressing the touch pad for GO 84 with AU in display 66, microprocessor 54 will initiate dryer operation with the presently selected or default parameters, and the drying LED 86 will be illuminated while the CLEAN FILTER LED 76 is extinguished. Upon completion of the automatic dry cycle, microprocessor 54 will automatically initiate COOL DOWN cycle, and will accordingly extinguish the DRYING LED 86 and illuminate the COOL DOWN LED 88. Also, the AU in display 66 will be changed to the number of minutes in the COOL DOWN cycle. If a WRINKLE-FREE option had been selected, it would follow the COOL DOWN cycle.

As described earlier, the microprocessor 54 awakens when one of the ON/SELECT touch pads 60–63 is pressed, and an automatic cycle is initially assumed. If, instead, the operator desires to dry for a particular time period (i.e. a TIME DRY cycle), the TIME touch pad 92 is pressed. Depending on the selected fabric type (or NO HEAT), a default number of minutes will appear in display 66. For example, if REGULAR had been selected, 40 minutes would appear. To increase this default time, the MORE touch pad 94 is pressed, and to decrease it, the LESS touch pad 96 is pressed. The change in time will be reflected in display 66. Once the GO touch pad 84 is pressed, the COOL DOWN time is added to the drying time and the sum appears in display 66. The SIGNAL, WRINKLE-FREE, and MEMORY SAVE options are also available in a TIME DRY cycle. The default times, available range, and operating temperatures for the TIME DRY cycles are shown below in Table 1.

TABLE 1

| | DEFAULT (MIN) | RANGE (MIN) | CYCLING TEMPERATURE (°F. ± 5°) |
|---|---|---|---|
| REGULAR | 40 | 1-93 | 144 |
| COOL DOWN | 6 | | |
| PERM PRESS | 30 | 1-89 | 144 |
| COOL DOWN | 10 | | |
| DELICATES | 20 | 1-93 | 115 |
| COOL DOWN | 6 | | |
| KNITS | 40 | 1-89 | 140 |
| COOL DOWN | 10 | | |
| NO HEAT | 20 | 1-99 | NA |

Anytime dryer 10 has been set to GO in either the AUTOMATIC. NO HEAT or TIME DRY cycles, the operator can make the following modifications while the dryer is running. First, in TIME DRY and NO HEAT operation, time can be added or subtracted by pressing the MORE touch pad 94 or LESS touch pad 96. Second, in an AUTOMATIC cycle, the VERY DRY touch pad 70, EXTRA DRY touch pad 72, NORMAL touch pad 68 and DAMP touch pad 74 may be pressed. Operation can be terminated by opening door 24, or pressing STOP touch pad 98 or RESET touch pad 100.

Referring to FIG. 4, there is shown a detailed flow diagram which depicts operation of microprocessor 54 in an automatic drying cycle, including interface to the operator and control of dryer action. As described with reference to FIG. 3, the operator initially presses one of touch pads 60-63 of the ON/SELECT as shown in block 120. More specifically, the operator presses one of the touch pads for REGULAR 60, PERM PRESS 61, DELICATES 62, or KNITS 63. This action "wakes up" microprocessor 54 and provides an indication of the fabric type that will be dried. Optionally, as indicated by DRYNESS block 122, the operator may select one of touch pads VERY DRY 70, EXTRA DRY 72, or DAMP 74 so as to alter the default value of NORMAL 68 as the desired final dryness of the clothes. If none of the dryness pads is selected, microprocessor assumes the dryness to be NORMAL.

As indicated by block 124, microprocessor 54 first determines the cycling temperature in response to the fabric type and desired dryness. More specifically, microprocessor 54 here determines the cycling or upper regulating temperature by using a look-up table, an example of which is given below in Table 2.

TABLE 2

| | CYCLING TEMP (±5° F.) | TIME TO FIRST OFF CYCLE (MIN) | | | COOL DOWN (MIN) |
|---|---|---|---|---|---|
| REGULAR | | >25 | 10<t<25 | <10 | |
| VERY DRY | 150° F. | 12 cycles | 14 cycles | 16 cycles | 3 MIN |
| EXTRA DRY | 150 | 8 | 10 | 12 | 6 |
| NORMAL | 144 | 4 | 8 | 10 | 6 |
| DAMP | 135 | 1 | 2 | 4 | 3 |
| PERM PRESS | | >20 | 10<t<20 | <10 | |
| VERY DRY | 144 | 6 | 7 | 8 | 8 |
| EXTRA DRY | 144 | 5 | 6 | 7 | 10 |
| NORMAL | 144 | 3 | 4 | 5 | 10 |
| DAMP | 120 | 1 | 1 | 1 | 8 |
| DELICATES | | >10 | <10 | | |
| VERY DRY | (NA) | | | | |
| EXTRA DRY | 120 | 6 | 6 | | 6 |
| NORMAL | 115 | 2 | 3 | | 6 |
| DAMP | 110 | 1 | 1 | | 3 |
| KNITS | | >15 | <15 | | |
| VERY DRY | 145 | 6 | 10 | | 8 |
| EXTRA DRY | 145 | 4 | 8 | | 10 |
| NORMAL | 140 | 3 | 6 | | 10 |
| DAMP | 130 | 1 | 2 | | 8 |

As an example, if the operator selected REGULAR as the fabric type and EXTRA DRY as the desired final doneness, then microprocessor 54 would determine the upper cycling temperature to be 150° F. from the look-up table. As described earlier, the dryness input is optional, and if none was selected, microprocessor 54 would select NORMAL as the default dryness; for the example shown in Table 2, the upper cycling temperature would then be 144° F. for a REGULAR fabric type. The upper cycling temperatures as shown in Table 2 were experimentally determined. Generally, it is desirable to dry the clothes at approximately the maximum temperature that does not damage or degrade the appearance of the clothes. By using the maximum temperature, the drying time is, of course, minimized. It was found that even one cycle at the maximum temperature would dry the clothes more than DAMP; accordingly, if the operator selects DAMP as the final dryness state, microprocessor 54 reduces the upper cycling temperature from what would be used for NORMAL dryness. As an example as shown in Table 2, REGULAR clothes would be dried at 135° F. if DAMP were the desired dryness, and at 144° F. if NORMAL were the desired dryness.

As described earlier with reference to FIG. 3, the operator may select various options such as MEMORY SAVE, SIGNAL, and WRINKLE-FREE before starting an automatic drying cycle. When GO touch pad 84 is finally pressed as indicated by block 126 in FIG. 4, microprocessor 54 starts a drying cycle as indicated by block 128. This involves microprocessor 54 closing relays 56 and 58 to start motor 52 running and activate electric heating element 50; see block 130. Additionally, as indicated by block 132, microprocessor 54 starts first cycle timer 108 for determining how long it takes for the exhaust air to rise to the cycling or upper regulating temperature. As indicated in block 134, microprocessor 54 continually monitors thermistor 42 to see if the cycling temperature has been reached. In order to prevent lint build-up and corrosion on the leads of thermistor 42 which could affect the accuracy of the device, thermistor 42 may be encapsulated in a metal cap (not shown) which causes the measured temperature to lag the actual temperature. Temperature sensor 102 here provides compensation for this lag. When the cycling or regulating temperature as determined by the look-up table 104 is reached, microprocessor 54 opens relay 58 to deenergize heating element 50 as indicated by block 136, and stops the first cycle timer 108.

Figure 5:
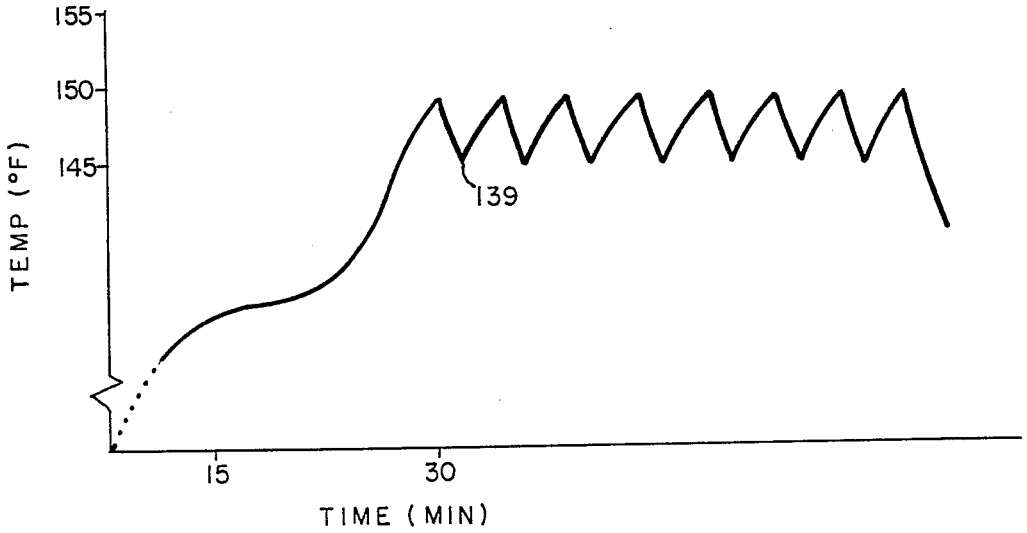
FIG. 5 shows a representative view of a plurality of sequential heating cycles.

The interval of time for the exhaust air as measured by thermistor 42 to reach a specified temperature varies with the load size, fabric type, amount of moisture in the load, rate of evaporation, the way the clothes tumble, and the amount of air flow through the load, as well as the ambient temperature and humidity. As a result of extensive laboratory testing using various load sizes to measure the time period to the off state in the first cycle and then counting the number of additional cycles to reach the desired percent of dryness, it was found that the interval of time could be used to predict the total of number of cycles required. A matrix was developed, and it appears above in Table 2. For example, for a REGULAR fabric load, if the time to the first off cycle was between 10 and 25 minutes, 7 additional cycles, or a total of 8, would generally dry the clothes to NORMAL dryness. As an another example, for a REGULAR fabric type, if the time to the first off cycle was longer than 25 minutes, a total of 8 cycles would generally dry the clothes to an EXTRA DRY dryness. This example is depicted in FIG. 5. For the EXTRA DRY selection of a REGULAR fabric type, the upper cycling temperature is 150° F. The temperature of the exhaust air as sensed by thermistor 42 rises until, at approximately 30 minutes, it reaches 150° F. At this point, microprocessor 54 deenergizes heating element 50. After a brief overshoot in temperature which is not shown, the exhaust air temperature begins to drop. In response to some suitable mechanism, heating element 50 is again activated for a second cycle beginning at point 139. In conventional prior art dryers, the ON/-OFF cycling was typically activated by a bimetallic switch or thermostat. Here, microprocessor 54 reactivates heating element 50 at a predetermined lower cycling or regulating temperature which may, for example, be several degrees below the upper regulating temperature. In FIG. 5, the lower regulating temperature is shown to be at approximately 145° F., or 5° below the upper regulating temperature of 150° F. Microprocessor 54 also has an override function that prevents the heater 50 from being cycled on for a predetermined number of seconds; this feature has primary advantage in a dryer having gas as the source of heat.

Referring again to FIG. 4 and specifically to block 138, microprocessor 54 uses a matrix look-up table 110 such as illustrated in Table 2 to determine the number of drying cycles to be executed. As shown in FIG. 4, this determination is a function of the time interval to reach the upper cycling temperature in the first cycle along with the fabric type and desired dryness. In response to this determination as shown in block 138, microprocessor 54 executes the required number of drying cycles as depicted by block 140. Returning again to the illustrative example as shown in FIG. 5, for an EXTRA DRY selection of a REGULAR fabric type, if the first cycle-to-off took more than 25 minutes, 7 additional, or a total of 8 cycles, would be executed. The 8 cycles are illustratively shown in FIG. 5. It is noted that 90 minutes is the maximum amount of drying time allowed in the AUTOMATIC mode of drying. If 90 minutes of drying time is reached before all cycles are completed, the heating element 50 will be turned off and the COOL DOWN mode will be commenced. In essence, this override is for a category of first cycle times that are not included in the look-up table. That is, it is for large clothes loads that may take considerably longer than, for example, 25 minutes to reach the upper regulating temperature during the first cycle, but are dry in fewer cycles than would be indicated by Table 2. Further, it is noted that although Table 2 shows the use of the time to off during the first cycle to determine the total number of cycles to be executed, such time interval also corresponds to the total number of minutes required to dry, and microprocessor 54 could be used to control such operation. Also, it could correspond to the total off-time of heating element 50.

Still referring to FIG. 4 and specifically to block 142, a COOL DOWN cycle is automatically run at the completion of the drying cycles as determined by the look-up table 110. More specifically, as shown in Table 2 above, the length of the COOL DOWN cycle in minutes is determined as a function of the fabric type and desired dryness. Generally, a COOL DOWN cycle is used to lower the temperature of the clothes to room temperature while tumbling so as to reduce or eliminate wrinkles. Also, it may be used to reduce the temperature of the metal drum 20 so that the operator won't touch a hot surface. In any event, it was found that a COOL DOWN cycle of NORMAL length would dry the clothes more than the desired DAMP state. Accordingly, if the operator selects a final state of DAMP, the length of the COOL DOWN cycle is reduced from what it would be for NORMAL dryness. Also, for VERY DRY at the other end of the dryness scale, the COOL DOWN cycle is reduced relative to the NORMAL COOL DOWN; accordingly, the clothes are warmer than room temperature at the end of the COOL DOWN cycle which gives an illusion of being more than normally dry. As shown in block 144, the COOL DOWN cycle is then executed.

As described earlier and as shown in block 146 of FIG. 4, WRINKLE FREE is an optional cycle that can be run after COOL DOWN. As indicated by block 148, microprocessor 54 checks to see whether WRINKLE FREE has been selected. If it has, a WRINKLE FREE cycle is executed as shown by block 150. If not, microprocessor 54 goes to STOP 152.

This completes the description of the preferred embodiment. A reading of it by those skilled in the art will bring to mind many modifications and alterations without departing from the spirit of the invention. Accordingly, it is intended that the scope of the invention will be limited only by the appended claims.

What is claimed is:

1. The method of drying a load of clothes irrespective of the load size in a clothes dryer, comprising the steps of:

determining a cycling temperature for said dryer in accordance with the fabric type of said load and the desired final dryness;

measuring irrespective of said load size the time to raise a thermal sensor of said dryer to said cycling temperature while applying heat to said load of clothes;

determining the remaining number of on and off temperature regulating cycles in accordance with said measured time and the fabric type of said clothes; and cycling said dryer on and off for said remaining number of cycles.

2. The method of drying clothes in a clothes dryer which, in response to a thermal sensor, cycles the heat source on and off to regulate the maximum drying temperature, comprising the steps of:

determining said maximum drying temperature in accordance with the fabric type of said clothes;

measuring the on-time of said heat source to reach said maximum drying temperature during the first of said cycles;

determining the remaining number of cycles to be executed in accordance with said first cycle on-time;

counting the number of cycles;

terminating the drying of said clothes when said remaining number of cycles are counted; and executing a cool-down cycle having a duration determined in accordance with said fabric type and the desired final dryness of said clothes.

3. The method recited in claim 2 wherein said maximum drying temperature in also determined in accordance with the desired final dryness of said clothes.

4. The method recited in claim 3 wherein the remaining number of cycles is determined from a look-up table.

5. A clothes dryer comprising:

a heat source;

a thermal sensor for providing a signal corresponding to the drying temperature;

an operator actuated control for providing a signal corresponding to the fabric type;

an operator actuated control for providing a signal corresponding to the desired final dryness;

means responsive to said fabric type signal and said desired final dryness signal for determining a cycling temperature for regulating the maximum drying temperature of said dryer;

means responsive to said thermal sensor signal for cycling said heat source at said cycling temperature;

means for measuring the on-time of said heat source during a first one of said on and off cycles;

means responsive to said measured time for determining the number of drying cycles to be executed; and means responsive to said fabric type signal and said desired final dryness signal for determining duration of a cool-down cycle subsequent to the last of said on and off drying cycles.

6. The dryer recited in claim 5 wherein said cycle number determining means is also responsive to said fabric type signal.

7. The method of drying clothes in a clothes dryer, comprising the steps of:

determining the upper regulating temperature for cycling off the heating source of said dryer in accordance with the fabric type and desired final dryness of said clothes;

measuring the time duration during the first cycle of said heating source to reach said upper regulating temperature;

determining the remaining number of cycles of said heating source in accordance with said measured time duration, said fabric type, and said desired final dryness;

counting the number of cycles until said remaining number of cycles is reached; and deactivating said heat source and tumbling said clothes for a cool-down period determined in accordance with said fabric type and said desired final dryness of said clothes.

* * * * *